US006732741B1

(12) United States Patent
Park

(10) Patent No.: US 6,732,741 B1
(45) **Date of Patent: *May 11, 2004**

(54) LIGHTER WITH CIGAR CUTTER

(76) Inventor: Keith K. Park, 921 Calle Simpatico, Glendale, CA (US) 91208

( * ) Notice: Subject to any disclaimer, the term of this patent is extended or adjusted under 35 U.S.C. 154(b) by 32 days.

This patent is subject to a terminal disclaimer.

(21) Appl. No.: 09/974,456

(22) Filed: Oct. 9, 2001

Related U.S. Application Data

(63) Continuation of application No. 09/453,349, filed on Dec. 1, 1999, now Pat. No. 6,298,856.

(51) Int. Cl.[7] ..... A24F 13/24; A24F 13/20

(52) U.S. Cl. ..... 131/249; 131/255; 131/248; 431/253

(58) Field of Search ..... 131/249, 248, 131/255, 253; 431/135, 253, 350, 150, 129, 144, 152; 219/260, 267, 270; 361/247; 827/130, 141, 142, 143, 154, 157

(56) References Cited

U.S. PATENT DOCUMENTS

| | | | | | |
|---|---|---|---|---|---|
| 3,899,285 | A | * | 8/1975 | Christmas | 431/152 |
| 4,040,541 | A | * | 8/1977 | Brooks | 220/339 |
| D410,563 | S | | 6/1999 | Reynolds | |
| D429,027 | S | * | 8/2000 | Song | D27/142 |
| 6,298,856 | B1 | * | 10/2001 | Park | 131/249 |

OTHER PUBLICATIONS

Prometheus Product Catalog (4 selective pages), Spring 1998.
Prometheus advertisement (Oct. 1998).

* cited by examiner

*Primary Examiner*—Dionne A. Walls
(74) *Attorney, Agent, or Firm*—Knobbe Martens; Olson & Bear LLP

(57) ABSTRACT

The invention provides a lighter comprising a body and an end portion having a hinged connection with the body. The body includes a recess at its lower end. The end portion includes a cigar cutter, comprising an elongated generally tubular blade, extending from a surface of the end portion. The end portion is movable between a closed position and an open position. In the closed position, the cutter extends within the recess and is not exposed. In the open position, the cutter does not extend into the recess. The lighter may also comprise a retainer comprising a leaf spring attached to the lower end of the body, and a slot within the end portion. In the closed position, the leaf spring is received within the slot, retaining the end portion in the closed position. Also, a lighter fuel inlet valve extends from the body and is within the recess thereof. The inlet valve is accessible through a channel in the end portion when the end portion is closed. The inlet valve is also accessible when the end portion is open. Advantageously, the lighter of the present invention utilizes a design that minimizes the risk of injury resulting from contact between the user's hands and the blade or fuel. Another advantage of the lighter of the present invention is that spilt fluid intended to be injected into the inlet valve can be collected in the recess of the lighter body and properly disposed of.

7 Claims, 4 Drawing Sheets

FIG. 1A
(PRIOR ART)
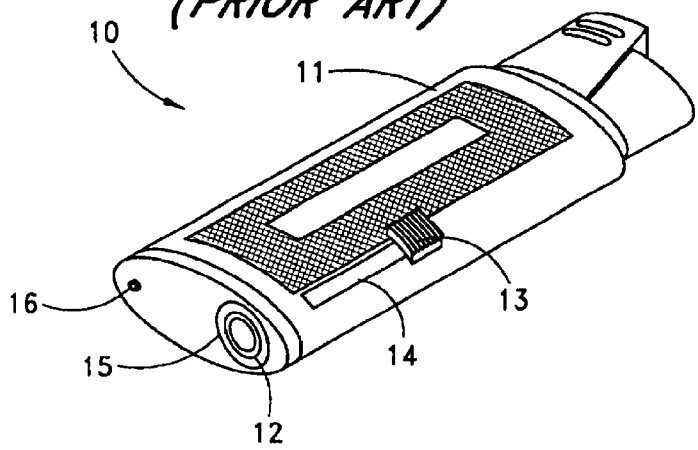
FIG. 1B
(PRIOR ART)
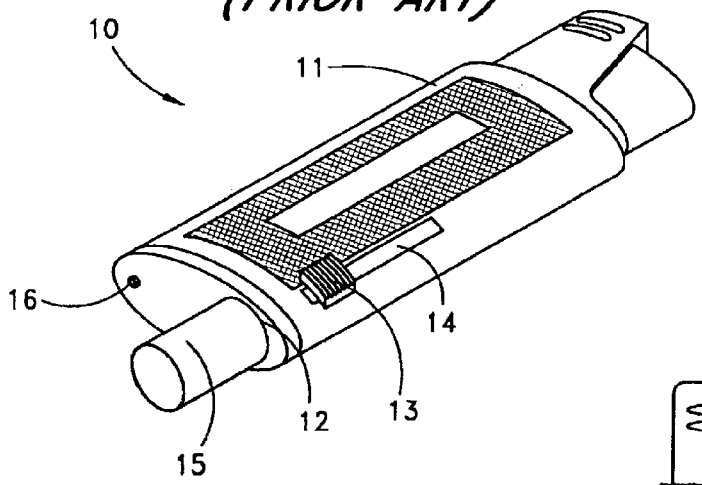
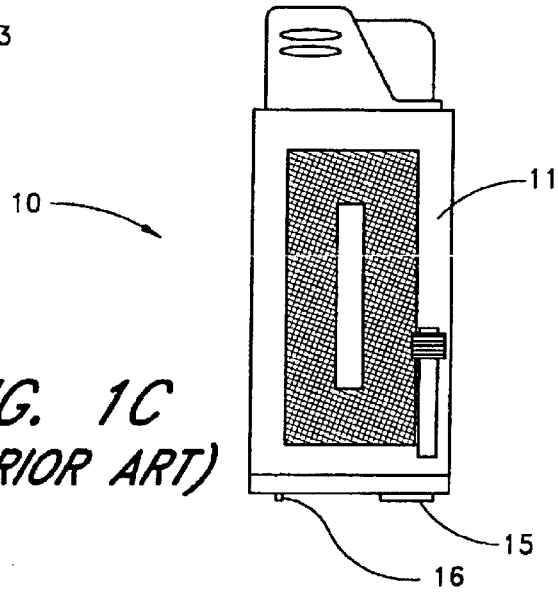
FIG. 1C
(PRIOR ART)

LIGHTER WITH CIGAR CUTTER

RELATED APPLICATION

This application is a continuation of application Ser. No. 09/453,349, filed on Dec. 1, 1999, now U.S. Pat. No. 6,298,856.

BACKGROUND OF THE INVENTION

1. Field of the Invention

The present invention relates generally to cigar cutters and, in particular, to a device combining a lighter with a cigar cutter.

2. Description of the Related Art

It is known to produce lighters which include cigar cutters. Such a combination is very useful for cigar smokers. One type of cigar cutter is an elongated tubular blade which can be inserted into an end of a cigar to facilitate removal of a potion of a cigar wrapper. One particular lighter which has been sold in the United States and elsewhere includes a cigar cutter comprising an elongated tubular blade inside of an annular cavity within the body of the lighter. The cigar cutter is longitudinally slidable with respect to the lighter body. In particular, the cutter is slidable between a retracted position, in which the blade tip is inside of the lighter body, and an extended or actuated position, in which the blade tip extends outside of the lower end of the body of the lighter. In the actuated position, a user can cut a cigar wrapper with the exposed portion of the cutter.

It is also known to produce lighters which include an interface for refilling the lighter with lighter fuel. For example, many lighters include a short lighter fuel inlet valve or tube through which lighter fuel can be injected into the lighter. The valve typically extends from the lighter body.

Unfortunately, a disadvantage of lighters such as the above-described lighter is that the sliding configuration of the cigar cutter may cause injury to users. The cutter can conceivably occupy a position in which the blade tip is only slightly outside of the lighter body. In this position, a user may not notice that the blade is exposed and may cut his or her fingers while clutching the lighter. Another disadvantage is that liquid fuel intended to be injected into the inlet valve may spill onto the ground and be wasted, or may drip undesirably onto the user's hands. It would be desirable to provide the fuel inlet within a cavity in the lighter body to more safely inject fuel into the lighter.

SUMMARY OF THE INVENTION

Accordingly, it is a principle object and advantage of the present invention to overcome these limitations and to provide an improved lighter having a cigar cutter.

In one embodiment, the present invention provides a lighter comprising a body and an end portion having a hinged connection with the body. The body includes a recess, and the end portion includes a cigar cutter, such as an elongated generally tubular blade, extending from a surface of the end portion. The end portion has a first position in which the cutter extends into the recess, and a second position in which the cutter extends away from the recess.

In another embodiment, the present invention provides a lighter comprising a body including a recess, and a fuel inlet valve within the recess. The inlet valve is in fluid communication with a chamber within the body. The recess is configured to collect spilled fuel intended to be injected into the inlet valve.

Advantageously, the lighter of the present invention utilizes a design that minimizes the risk of injury resulting from contact between the user's hands and the blade. This is due to the high likelihood that the user will notice if the end portion is in the open position in which the blade is exposed. Another advantage of the lighter of the present invention is that spilled fuel intended to be injected into the inlet valve can be collected in the recess of the lighter body and properly disposed of.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

BRIEF DESCRIPTION OF THE DRAWINGS

FIG. 1A is a perspective view of a prior art lighter having a slidable cigar cutter, shown with the cutter retracted;

FIG. 1B is a perspective view of the prior art lighter of FIG. 1A, with the cutter extended;

FIG. 1C is a side view of the prior art lighter of FIG. 1A, with the cutter only slightly extended;

DETAILED DESCRIPTION OF THE PREFERRED EMBODIMENT

Figure 2:
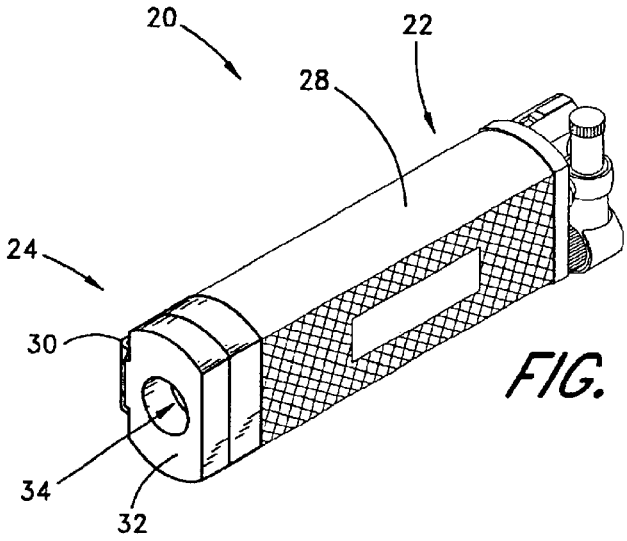
FIG. 2 is a perspective view of a lighter having features in accordance with the teachings of the present invention, shown with an end portion in a closed position.

FIGS. 1A–C show a prior art lighter 10 including a sliding cigar cutter 15 comprising an elongated tubular blade. FIG. 1A shows the lighter 10 with the cutter 15 in a completely retracted position. FIG. 1B shows the lighter 10 with the cutter 15 in a completely extended position. The lighter 10 comprises a body 11 having a longitudinal annular cavity 12. The cutter 15 is inside of the cavity 12 and is slidable therein. A slot 14 is provided in the lighter body 11. A switch 13 is attached to the cutter 15 and extends through the slot 14 to the exterior surface of the body 11. In use, the cutter 15 is exposed by sliding the switch 13 toward the lower end of the lighter body 11, as shown in FIG. 1B. Similarly, the cutter 15 is retracted by sliding the switch 13 toward the upper end of the body 11, as shown in FIG. 1A.

A disadvantage of the prior art lighter 10 is that the cigar cutter 15 may occupy a slightly extended position, as shown in FIG. 1C. This may occur if the switch 13 is slightly pushed down, or if the user fails to completely retract the switch 13 after using the cutter 15. When the cutter 15 is in the position shown in FIG. 1C, the user may fail to notice the blade before clutching the lighter 10. As a result, the user's hands or fingers may be severely cut. Thus, the lighter 10 of the prior art is not safe.

The prior art lighter 10 also includes a lighter fuel inlet valve 16 on the body 11, through which lighter fuel may be injected into the lighter 10. The inlet valve 16 is in fluid communication with a lighter fuel chamber within the body 11. Unfortunately, a limitation of the lighter 10 is that spillage of liquid fuel may result in dripping of the fuel undesirably onto the user's hands. Because the fuel is often flammable, this presents a safety risk to the user. Moreover, because the valve 16 extends from the body 11, it may be damaged if the lighter is dropped or roughly handled, thus, shortening the useful life of the lighter.

FIG. 2 shows a lighter 20 according to a preferred embodiment of the present invention. Lighter 20 includes a body 28 having an upper end 22 and a lower end 24. The upper end 22 includes standard elements of a lighter known to those skilled in the art. The lighter 20 can be of any of a variety of types, such as a flint lighter, jet turbo lighter, an electronic piezo lighter or other lighters known in the art. The lower end 24 of the lighter body 28 is preferably connected via a hinge 30 to an end portion 32 including a cigar cutter. In FIG. 2, the end portion 32 is in a closed position in which the blade of the cutter is not exposed. The end portion 32 includes a cylindrical channel 34 as shown.

Figure 3:
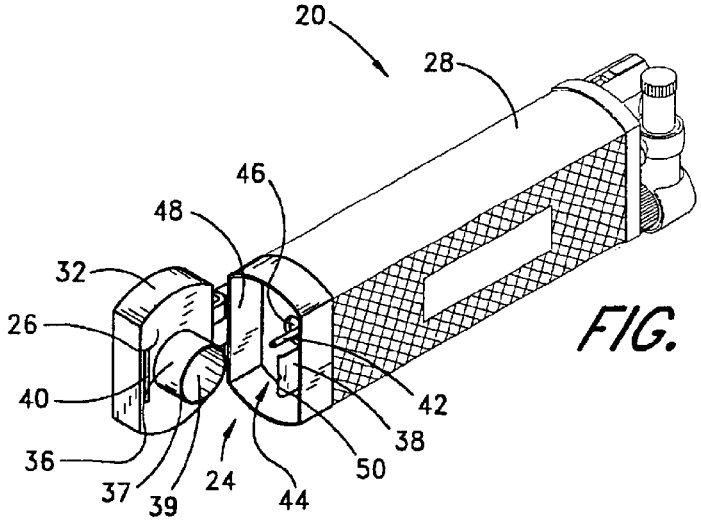
FIG. 3 is a perspective view of the lighter of FIG. 2, shown with the end portion in a partially open position.
Figure 4:
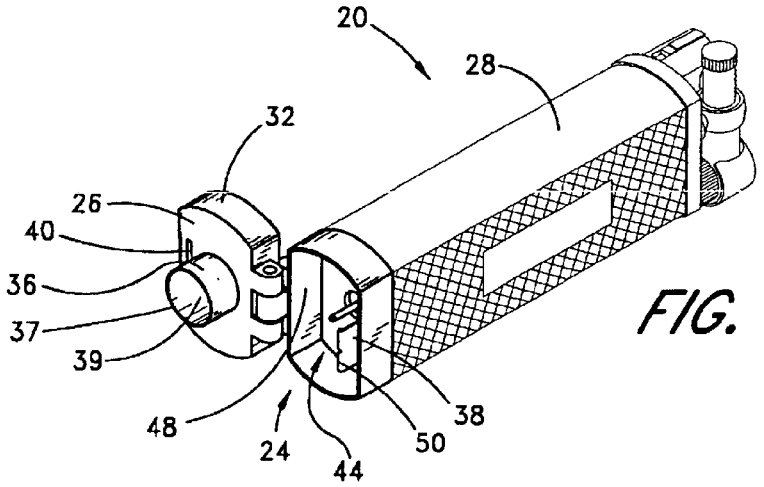
FIG. 4 is a perspective view of the lighter of FIG. 2, shown with the end portion in a completely open position.

FIGS. 3 and 4 show the lighter 20 with the end portion 32 in partially open and completely open positions, respectively. As shown, the lower end 24 of the body 28 preferably includes a recess 44 having an inner wall 48. The wall 48 includes a hole 46 through which extends a lighter fuel inlet valve 42. The inlet valve 42 is in fluid communication with a lighter fuel chamber inside of the body 28. Inlet valve 42 is accessible through channel 34 when the end portion 32 is closed, and is also accessible when end portion 32 is open. The end portion 32 includes a cigar cutter 36 comprising an elongated tubular blade 37 extending from an inner surface 26 of the end portion 32. Preferably, the cutter 36 is of equal size and concentric with the channel 34 so that the interior surface 39 of the cutter 36 forms a portion of the channel 34. When the end portion 32 is in the closed position, shown in FIG. 2, the cutter 36 extends into the recess 44 of the body 28. On the other hand, when the end portion 32 is in the completely open position, shown in FIG. 4, the cutter 36 does not extend into the recess 44.

The lighter 20 preferably includes a retainer comprising a leaf spring 38 extending longitudinally from an outer edge of the lower end 24 of the body 28, and a slot 40 within the surface 26 of the end portion 32. The leaf spring 38 preferably has a curved end 50 to engage the slot 40 when the end portion 32 is in the closed position shown in FIG. 2. When the end portion 32 is closed, the leaf spring 38 applies a force against the end portion 32 to retain the end portion 32 in the closed position. The end portion 32 can be opened by applying a force against the end portion 32, directed away from the body 28, to overcome the retaining force of the leaf spring 38 as will be easily understood by those of skill in the art. Alternatively, the spring 30 may provide sufficient friction to keep the end portion 32 in the closed position shown in FIG. 2 without the need for a spring 38 and slot 40. Moreover, other means including, but not limited to, latches, clamps, or friction interference may be used to secure the end portion 32 in the closed position yet readily permit a user to rotate the end portion 32 into the open position shown in FIG. 4.

Figure 5:
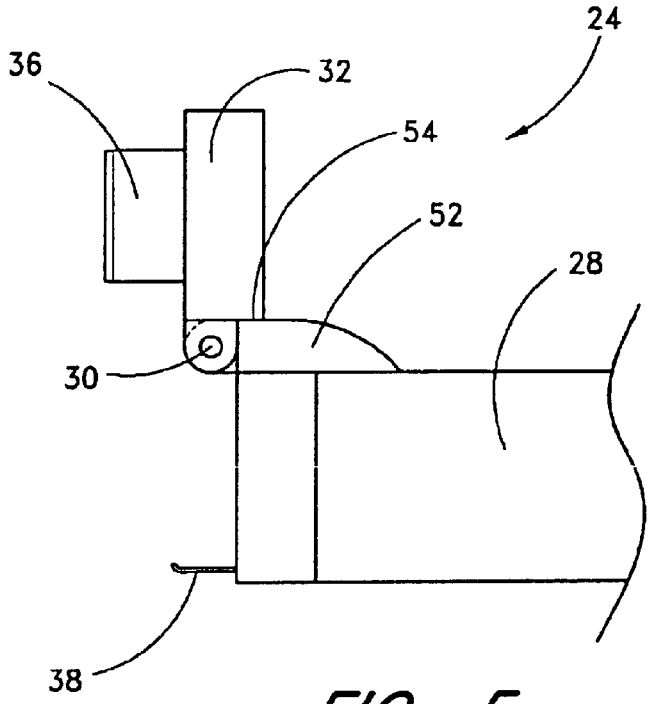
FIG. 5 is a top plan view of the lower end of the lighter of FIG. 4.

In the completely open position shown in FIG. 4, the end portion 32 is preferably restrained from further opening. In other words, the end portion 32 is restrained from turning any further about the hinge 30. Preferably, as shown in FIG. 5, the lower end 24 of the lighter body 28 includes a thin flange 52. The hinge connection of the body 28 preferably extends from the flange 52. When the end portion 32 is completely open, an edge 54 of the end portion abuts the flange 52, restraining any further opening of the end portion 32. Advantageously, a user can apply force against the blade 37, such as while cutting a cigar, without causing any swinging motion of the end portion 32. This allows the user to more easily use the cigar cutter 36. The cigar cutter may be manufactured from aluminum, other metals, plastic or wood.

The lighter 20 of the present invention is safer than the above-described prior art lighter 10. When the end portion 32 is in the closed position shown in FIG. 2, the blade 37 is not exposed. In this position, there is no risk of injury when the user clutches the lighter 20. Moreover, the retainer, comprised of the leaf spring 38 and slot 40, retains the end portion 32 in the closed position. When the end portion 32 is in an open position, such as the positions shown in FIGS. 3 and 4, the user is very likely to notice the exposed blade 37. Before clutching the lighter 20, the user will likely close the end portion 32 or be careful to avoid contact with the blade 37. Thus, the design of the lighter 20 of the present invention advantageously prevents injury.

Figure 6:
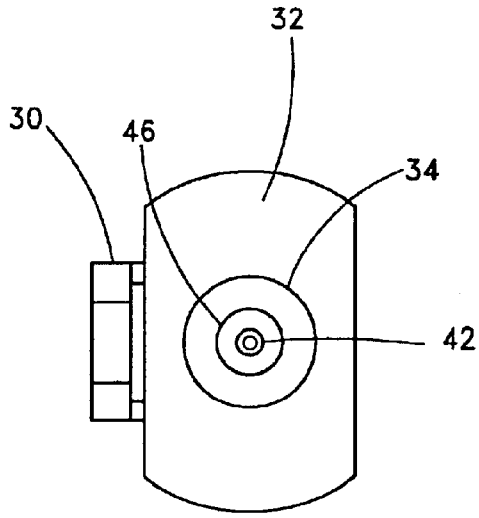
FIG. 6 is a left side elevational view of the lighter of FIG. 2.
Figure 7:
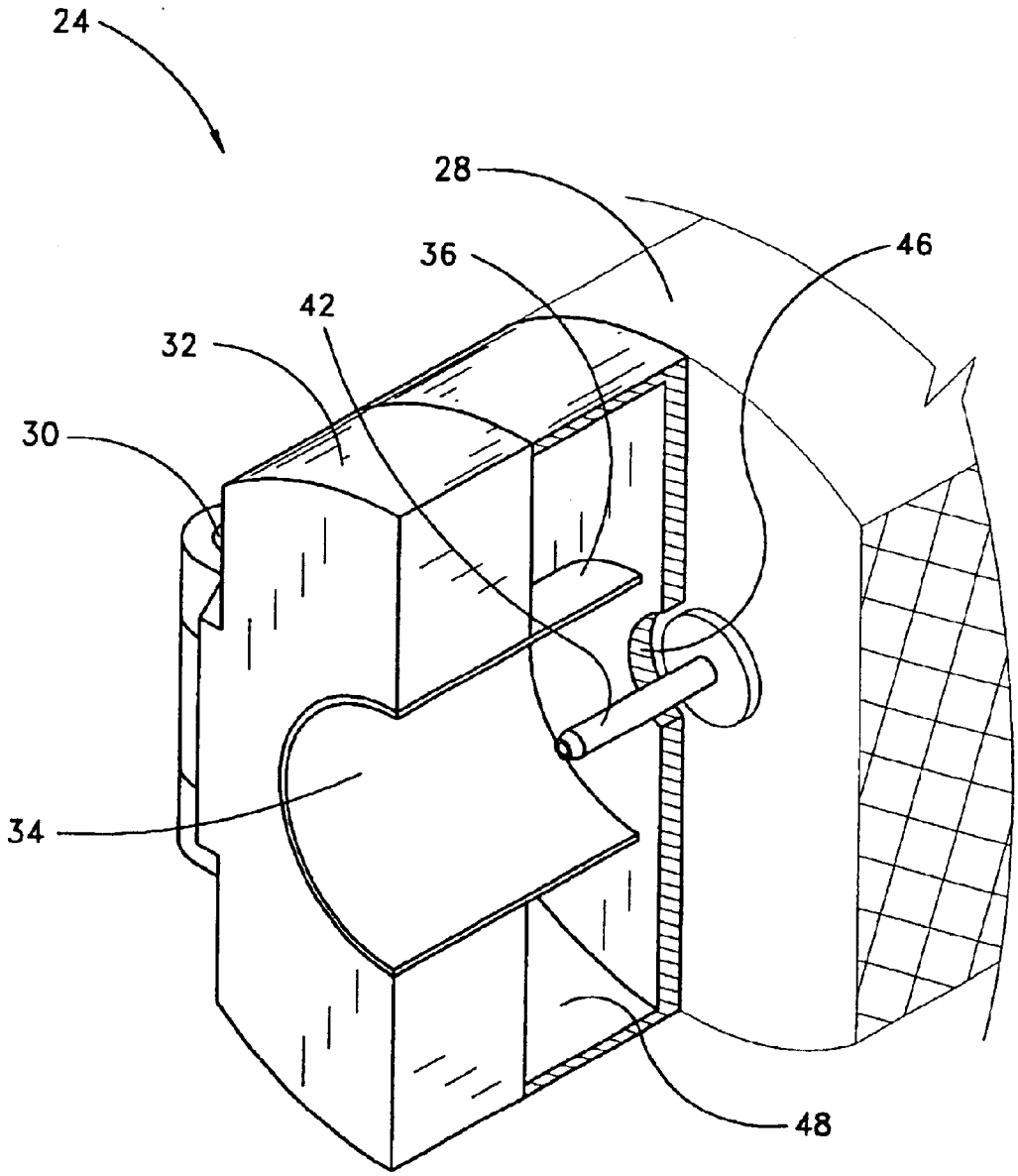
FIG. 7 is a partially sectional perspective view of the lower end of the lighter of FIG. 2.

As can be seen in FIGS. 6 and 7, when the end portion 32 is closed, the fuel inlet valve 42 extends within the channel 34 of the end portion 32. Thus, a user can easily access the fuel inlet valve 42 when the end portion 32 is closed. To refill the lighter 20 with lighter fuel, the lighter body 28 is positioned upside down, so that the lower end 24 faces upward. Lighter fuel is injected downward into the inlet valve 42 using a fuel cartridge known to those of skill in the art. Depending upon the type of lighter 20, the fuel may be a liquid or a gas. If the lighter fuel is a liquid, a further advantage of the lighter 20 over prior art lighters such as the above-described lighter 10 is that the recess 44 of lighter 20 collects spilt fuel intended to be injected into the fuel inlet valve 42. Advantageously, the spilt fuel is prevented from further spilling onto the ground or onto the user's hands. The user can properly dispose of the spilt fuel by tilting the lighter 20 and pouring the fuel out of the recess 44 into a container, down a drain, etc. Preferably, once the user has filled the chamber in the lighter 20 through inlet valve 42 with fuel, the user may open the end portion 32 and conveniently pour the excess fuel out of the recess 44. Therefore, fuel is not spilled on the user creating a safety hazard. Alternatively, the lighter 20 may be provided without the end portion 32. In this embodiment, the lighter is not used as a cigar cutter, however, the lighter includes a reservoir to collect spilled fuel for easy and safe disposal. The reservoir may be provided with a spout for easy pouring of spilled fuel.

In use, the end portion 32 is normally kept in the closed position illustrated in FIG. 2. When a user would like to remove a portion of the wrapper of a cigar (not shown) the user simply opens the end portion 32 by rotating the end portion 32 about the hinge 30 into the open position illustrated in FIG. 4. As will be easily understood by those of skill in the art, the cigar cutter 36 is exposed and a portion of the wrapper of the cigar may be safely removed. Upon completion of this task, the end portion 32 is rotated from the position shown in FIG. 4 back to the safety position shown in FIG. 2.

By safely storing the cigar cutter 36 in the recess 44, another advantage of the invention is apparent. As shown in FIG. 2, in the closed position, neither the cutter 36 nor the inlet valve 42 are exposed. Thus, if the lighter 20 is dropped or roughly handled, neither the cigar cutter 36 nor inlet valve 42 will be damaged. To the contrary, if the cigar cutter of the prior art lighter 10 is inadvertently left exposed as shown in FIG. 1C and the lighter is dropped, both the cigar cutter and/or the inlet valve may be damaged, breaking the lighter. If the inlet valve is broken, the lighter becomes useless once the fuel supply is exhausted. Likewise, if the cutter is damaged, a user will need a separate implement to remove a portion of a wrapper of a cigar prior to lighting the cigar. As a result, the present invention extends the useful life of lighters including a cigar cutter.

Although a hinge 30 is shown in the embodiment of the lighter 20 illustrated in FIGS. 2–7, other attachment means of the end portion 32 to the body 28 of the lighter 20 may be used. For example, an interference fit may be provided between a flange on either the end portion 32 or body 28 and the other portion using an interference fit as will be understood by those of skill in the art. In this embodiment, the end portion 32 can be completely removed from the remainder of the lighter 20 and be lost. Thus, preferably the end portion 32 is secured in some fashion to the lighter 20. However, the present invention contemplates the end portion 32 and remainder of the lighter 28 being two independent pieces.

Likewise, the fuel chamber (not shown) may be integral with the body 28 of the lighter 20. As will be understood by those of skill in the art, in this embodiment, the hole 46 shown in FIGS. 3, 4 and 6 would not be necessary. The cigar cutter 36 may also be other shapes known to those of skill in art such as, elliptical, etc. Further, the body 28 and end portion 32 may be of any cross-sectional configuration including, but not limited to, circular, triangular, square, rectangular, quadrilateral, elliptical, etc. In the illustrated embodiment, the cross-section of the lighter has two opposed parallel sides and two opposed rounded sides. It will be easily understood that the advantages of the present invention may be incorporated on a lighter of any shape or size. In addition, the end portion 32 may not include the channel 34, so that the end portion presents a smooth outer surface of the bottom of the lighter 20. In this embodiment, the end portion 32 must be opened in order to access the inlet valve 42 to refill the lighter 20 with fuel. Preferably, the channel 34 is provided so that the cutter 36 does not have to be exposed as shown in FIG. 4 when the lighter 20 is refilled with fuel.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Thus, it is intended that the scope of the present invention herein disclosed should not be limited by the particular disclosed embodiments described above, but should be determined only by a fair reading of the claims that follow.

What is claimed is:

1. A lighter comprising:

a body including a recess and a first hinge portion adjacent the recess;

a panel including a second hinge portion, a first surface and a second surface; and a generally tubular blade extending from the first surface; wherein the first and second hinge portions cooperate to pivotably secure the panel to the body, such that the panel may occupy a first position in which the blade extends into the recess and the panel second surface defines an exterior surface of the lighter, and the panel may occupy a second position in which the blade does not extend into the recess.

2. The lighter of claim 1, further comprising a retainer configured to retain the panel in the first position.

3. The lighter of claim 2, wherein the retainer comprises a leaf spring extending from the body and a slot within the panel, the leaf spring adapted to engage the slot to retain the panel in the first position.

4. The lighter of claim 1, further comprising a fuel inlet valve extending from the body, the inlet valve being in fluid communication with a fuel chamber within the body.

5. The lighter of claim 4, wherein when the panel is in the first position, the inlet valve is accessible through a channel defined within the tubular blade.

6. The lighter of claim 4, wherein the inlet valve is located within the recess.

7. The lighter of claim 6, wherein the recess is configured to collect spilled fuel intended to be injected into the inlet valve.

* * * * *